US007089639B2

(12) United States Patent
Matthews Brown et al.

(10) Patent No.: US 7,089,639 B2
(45) Date of Patent: Aug. 15, 2006

(54) METHOD FOR MANUFACTURING SUPPORT PILLOWS

(75) Inventors: Susan H. Matthews Brown, Evergreen, CO (US); Sheila Littlehorn, Littleton, CO (US)

(73) Assignee: The Boppy Company, Golden, CO (US)

( * ) Notice: Subject to any disclaimer, the term of this patent is extended or adjusted under 35 U.S.C. 154(b) by 126 days.

(21) Appl. No.: 10/769,007

(22) Filed: Jan. 29, 2004

(65) Prior Publication Data

US 2005/0166378 A1 Aug. 4, 2005

(51) Int. Cl.
*B68G 7/06* (2006.01)
*A47G 9/10* (2006.01)

(52) U.S. Cl. ..... 29/91.1; 29/91; 5/636; 5/637; 5/644; 53/459; 53/467; 53/468; 53/469

(58) Field of Classification Search ..... 29/91, 29/91.1; 5/636, 637
See application file for complete search history.

(56) References Cited

U.S. PATENT DOCUMENTS 4,393,520 A * 7/1983 Koch ..... 2/16
5,016,303 A * 5/1991 Tanaka et al. ..... 5/636
5,103,879 A * 4/1992 Hickerson ..... 141/67
6,038,720 A * 3/2000 Matthews et al. ..... 5/639
6,052,848 A * 4/2000 Kelly ..... 5/632
6,230,349 B1 * 5/2001 Silver et al. ..... 5/636
6,279,185 B1 * 8/2001 Matthews ..... 5/655
6,453,493 B1 * 9/2002 Matthews Brown ..... 5/636

* cited by examiner

*Primary Examiner*—David P. Bryant
*Assistant Examiner*—Christopher Agrawal
(74) *Attorney, Agent, or Firm*—Townsend and Townsend and Crew LLP

(57) ABSTRACT

In one embodiment, a method for making a pillow comprises cutting at least one piece of fabric to form a pair of skins that each comprise a midsection and two arm sections. The two skins are sewn together near their outer edges except for a portion of the mid section to form a shell defining and interior and having a middle region with an opening into the interior and two opposing arms extending from the middle region to form a well region. A fill material is blown into the interior of the shell until the pillow has a firmness defined by an IFD of at least about 20 Newtons with 25% deflection, and the opening in the middle region is closed.

18 Claims, 9 Drawing Sheets

METHOD FOR MANUFACTURING SUPPORT PILLOWS

BACKGROUND OF THE INVENTION

This invention relates generally to the field of pillows. More specifically, the invention relates to methods for making pillows.

Pillows have a wide variety of uses. For example, pillows are used almost universally when sleeping to support the head. However, pillows may have a variety of other uses. For example, pillows may be used to support a baby, to provide back support or to hold an object in front of a person. For instance, nursing pillows may be used to support a nursing baby. One example of a pillow that may be used for such applications is the Boppy® support pillow, commercially available from The Boppy Company. Examples of such pillows are described in U.S. Pat. Nos. 5,261,134 and 5,661,861, the complete disclosures of which are herein incorporated by reference.

Pillows may be manufactured in a variety of ways and using a variety of materials. For instance, some manufacturers use small poly beads as a fill material. However, consumer safety groups discourage such materials for use with infants because the resulting pillow can easily conform to the baby's face. A safer approach is to use densely packed fibers to provide a firm pillow. One technique for filling pillows with fibers is by hand. However, this process can be expensive and can create bumps in the pillow.

BRIEF SUMMARY OF THE INVENTION

Hence, this invention is related to techniques for making pillows in a cost efficient manner. The techniques may also be used to produce relatively firm pillows, especially those that may be used around babies or small children.

In one embodiment, a method for making a pillow comprises cutting at least one piece of fabric to form a pair of skins that each comprise a midsection and two arm sections. The two skins are sewn together near their outer edges except for a portion of the mid section, forming a shell defining an interior and having a middle region with an opening into the interior and two opposing arms extending from the middle region to form a well region. A fill material is blown into the interior of the shell until the pillow has a certain firmness. For example, the pillow may have a firmness defined in terms of an Indentation Force Deflection (IFD) of at least about 20 Newtons at 25% deflection, and more preferably at least about 25 Newtons at 25% deflection. Once filled, the opening in the middle region is closed.

To introduce the fill material into the interior of the shell, a nozzle may be placed through the opening of the middle region and into one of the arms, after which the fill material is blown into the arm. The nozzle may then be moved to the other arm and more fill material is blown into this arm. The nozzle is then moved to the middle region and fill material is blown into the middle region.

In one aspect, the skins may have an outer surface and an inner surface, with the skins being sewn together with the inner surfaces facing each other. After sewing the skins together, the shell may be turned inside out such that the inner surfaces face each other. In some cases, the two skins may be substantially identical, with the two arm sections curving so that their ends generally face each other. Optionally, a strip of fabric or a gusset may be sewn between the two skins so as to be adjacent to the well region. After forming the pillow, it may be placed into a package.

In one particular aspect, the fill material may comprise polyester fibers, and the shell may be filled to about 2.0 pounds to about 2.5 pounds with the fill material. In some cases, the skins may be constructed from cotton. In another aspect, the opening may be closed by sewing the skins together.

DETAILED DESCRIPTION OF THE INVENTION

The invention provides various techniques for manufacturing and packaging pillows. The techniques may be used with a wide variety of materials, and will be particularly useful for pillows that need a certain firmness. Although not intending to be limiting, examples of support pillows that may be manufactured using the techniques of the invention include those described in U.S. Pat. Nos. 5,261,134, 5,661,861, 6,038,720, 6,055,687, 6,434,770, 6,532,612, 6,321,403, 6,279,185, 6,453,493, and 6,523,200, and copending U.S. application Ser. No. 10/046,377 filed Oct. 26, 2001; Ser. No. 09/884,742 filed Jun. 18, 2001; Ser. No. 09/802097 filed Mar. 8, 2001; Ser. No. 10/426,067, filed Apr. 28, 2003 Ser. No. 10/612266, filed Jul. 01, 2003, entitled "Multi-use Pillow and Methods" Ser No. 10/612267, filed Jul. 01, 2003, entitled "Support Pillow for Small Infants" and Ser. No. 10/627542, filed Jul. 25, 2003, entitled "Neck Ring With Detachable Bib", the complete disclosures of which are herein incorporated by reference. However, it will be appreciated that the invention may be used to make other pillows as well.

Figure 1:
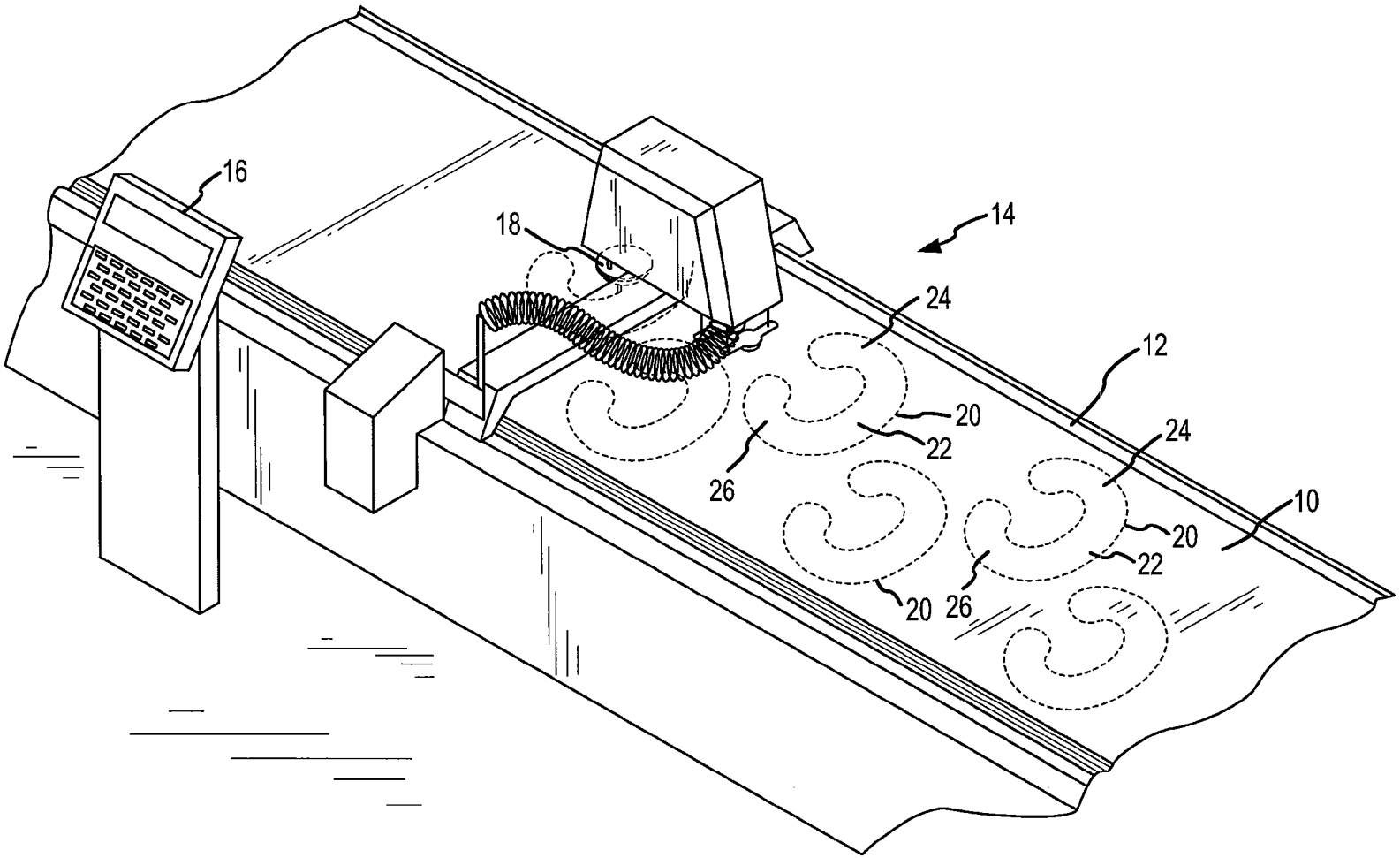
FIG. 1 is a perspective view of a machine for cutting skins used in making pillows according to one embodiment of the invention.

Referring now to FIG. 1, one method for making a pillow will be described. Initially, a material 10 used to make the pillow is selected. The material 10 is spread onto table 12 for cutting. This may be done in an automated manner using a cutting machine 14, such as a Gerber machine, commercially available from Gerber Technology Products. Examples of materials that may be used include cotton fabrics, nylon fabrics, polyester fabrics, natural or man-made textiles and the like. The cutting machine 14 may be configured to cut multiple layers of material at once, permitting layers of material to be placed on top of table 12.

Optionally a rice paper cover may be placed over the top layer of material for protection during cutting.

A cutting program may be entered into or selected using a computer 16. In turn, computer 16 moves a cutting head 18 along X, Y and Z axis to make the appropriate cut. Cutting head 18 includes a blade that cuts through the layers of material 10 to form sets of skins 20 (shown in phantom line). Each skin 20 has a midsection 22 and two curved arms 24 and 26. Also, each skin may have an inner surface and an outer surface. The outer surface may be patterned and is visible when the pillows is completed. The inner surface faces the interior of the pillow when finished and is generally not visible.

Figure 2:
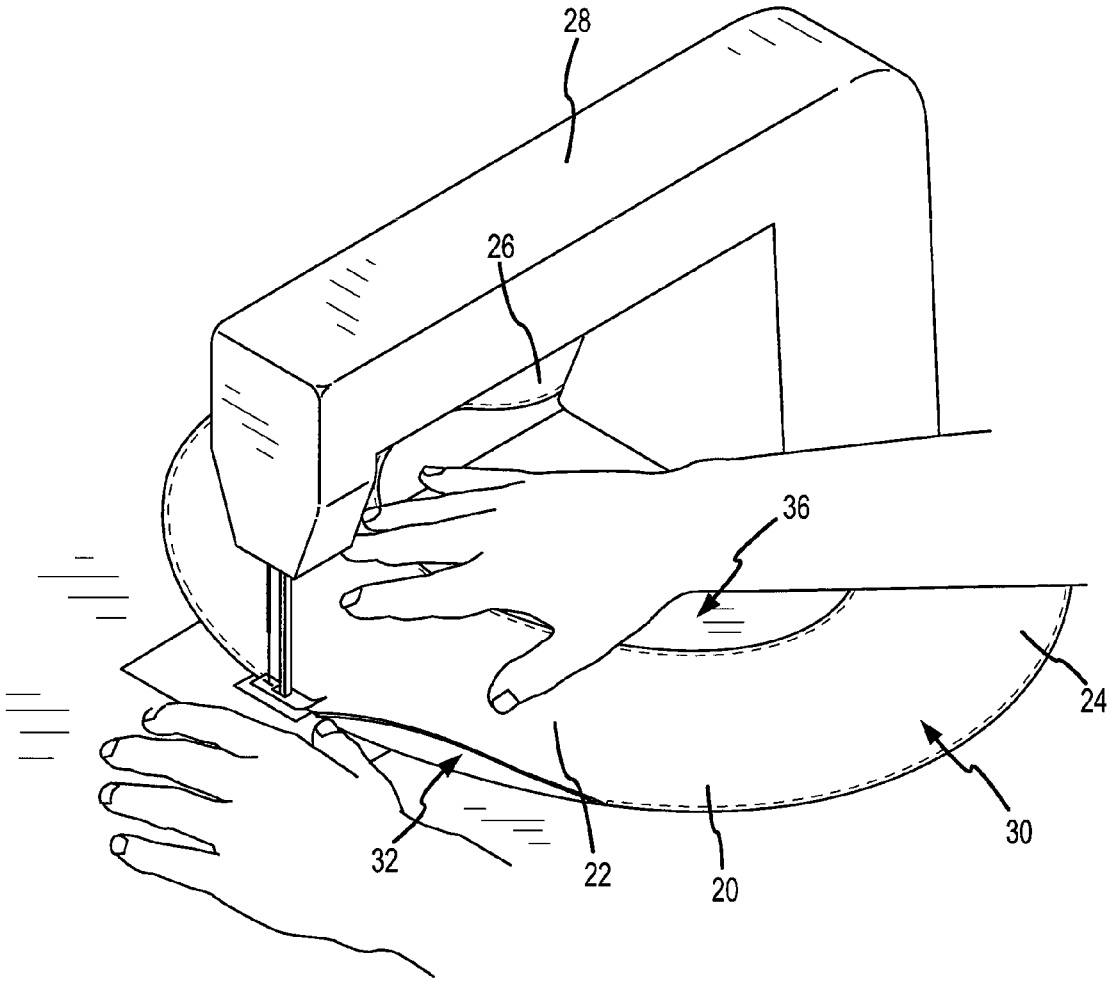
FIG. 2 is a perspective view of a sewing machine used to sew two skins together to form a pillow shell according to one embodiment of the invention.

Once skins 20 are cut, they are removed from table 14 and taken to sewing stations as described in connection with FIG. 2. Using a sewing machine 28, two skins 20 are sewn together, with their inner surfaces facing each other to form a shell 30. Because the inner surfaces face each other, shell 30 is sewn inside out. Also, skins 20 are sewn to each other near their outer edges except for a portion of the midsections 22 to form an opening 32 into the interior of the shell 30. Opening 32 may have a length of about 3 inches to about 9 inches, and more preferably at about 6 inches, particularly when filling the shells using a nozzle having a diameter of about 5 inches. After sewing is completed, shell 30 is turned inside out in preparation for filling.

In one embodiment, the pillow may be constructed using a center strip of material or gusset in a manner similar to that described in U.S. Pat. Nos. 6,279,185 and 6,412,128, incorporated herein by reference. In such cases, this strip of material may first be sewn to each skin 20 at the outer edges of skin 20 that define a well region 36. The sewer may then sew the rest of the edges together, and my optionally sew in a label.

Figure 3:
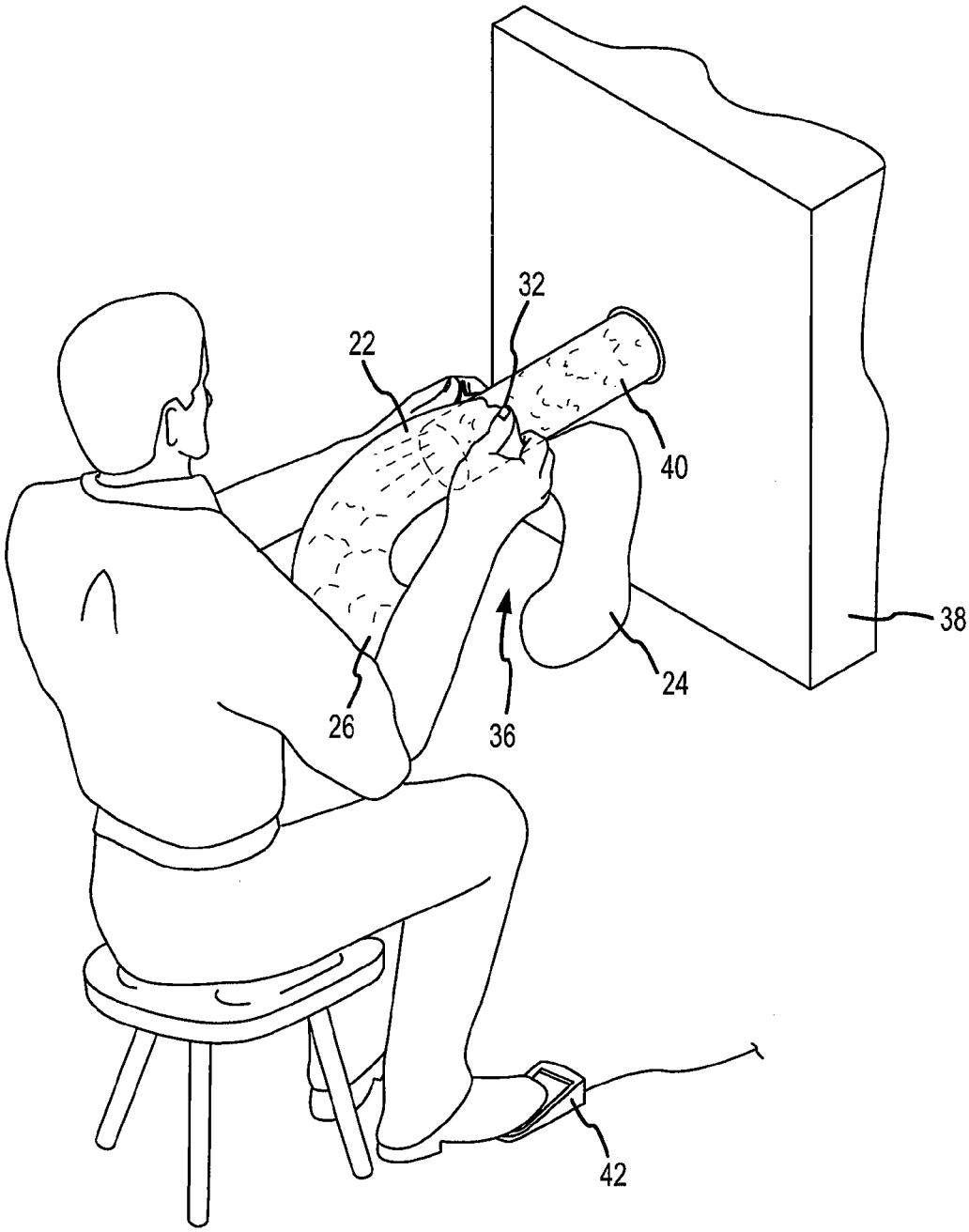
FIGS. 3–5 illustrate a method for introducing a fill material into a pillow shell according to one embodiment of the invention.
Figure 4:
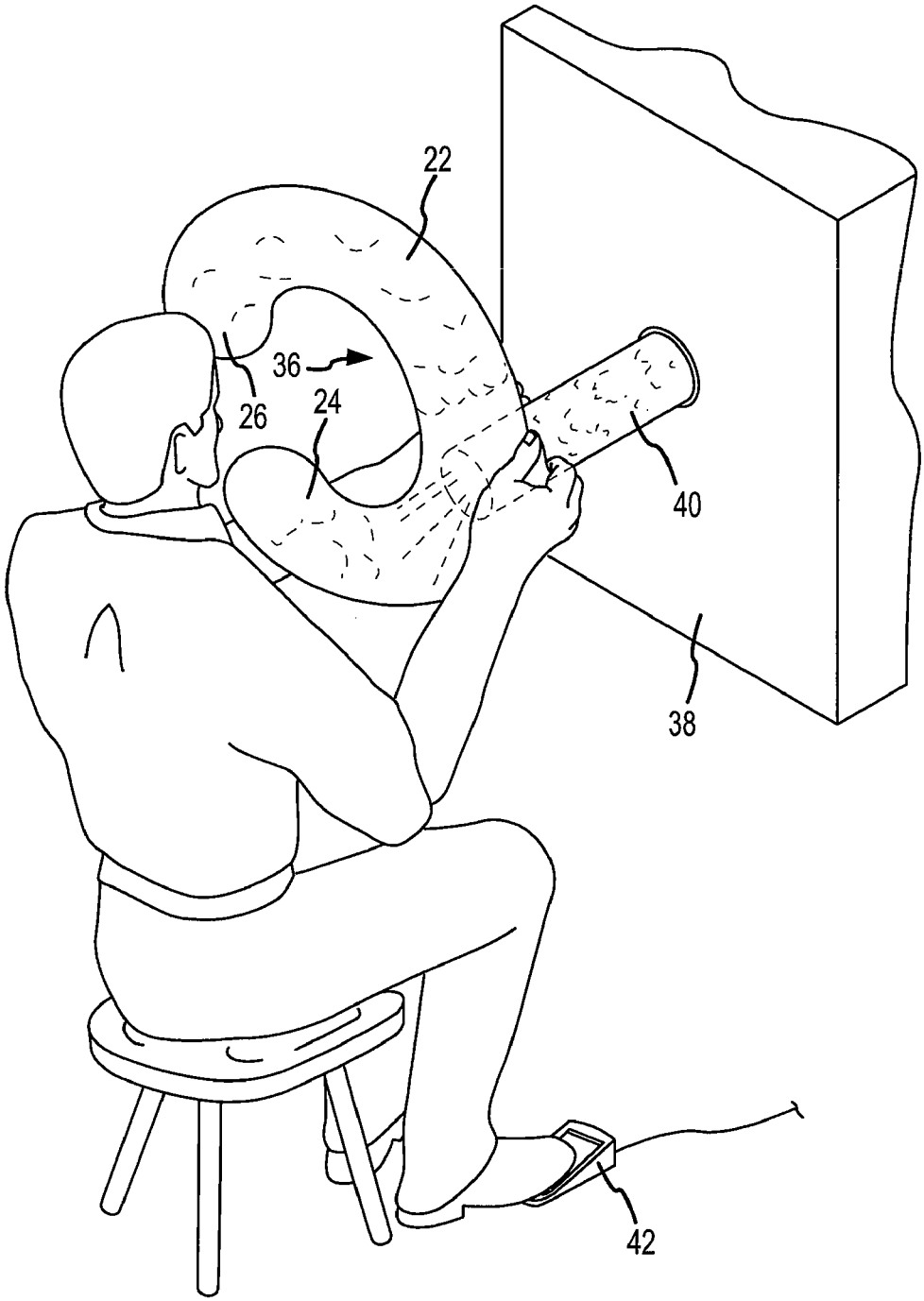
Figure 5:
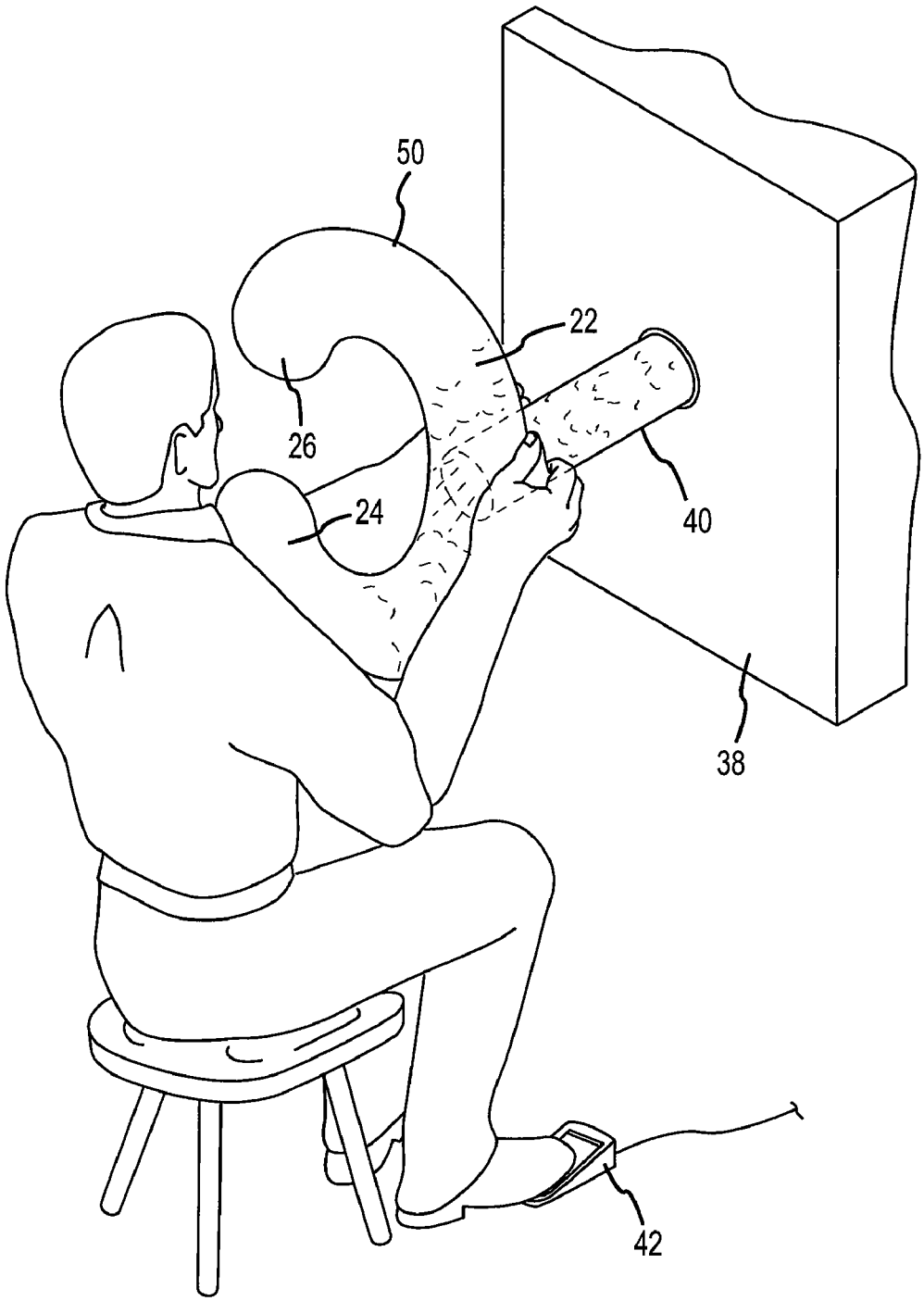

Following sewing, the shells 30 are taken to filling stations where a fill material is put into the interior. As shown in FIGS. 3–5, a blowing machine 38 may be used to fill each shell 30 with a fill material. Blowing machine 38 has a hopper for holding the fill material and a nozzle 40 through which the fill material is delivered. One type of blowing machine that may be used is a Loft Plus pillow system, commercially available from Wise.

As shown in FIG. 3, shell 30 is filled by inserting nozzle 40 into opening 32 and then moving nozzle 40 down into one of the arms, such as arm 26. The operator then presses a peddle 42 to cause pressurized fill material to be blown into arm 26. Once filled with the appropriate amount of fill material, the operator manipulates shell 30 so that nozzle 40 is within the other arm, such as arm 24 as illustrated in FIG. 4. The operator then presses peddle 42 to fill arm 24 with the appropriate amount of fill material. As shown in FIG. 5, the operator then moves nozzle 40 into midsection 22 and presses peddle 40 to finish filling the shell, thereby forming a pillow 50.

A wide variety of fill materials may be blown into shell 30. Exemplary materials include polyester fibers, such as a white hollow siliconized fiber (A grade), other natural and synthetic fibers, spheres, and the like. In one particular embodiment, the fibers may have dimensions in the range from about 6 denier by about 1.25 inch to about 2 inches to about 7 denier by about 1.25 inch to about 2 inches.

Shell 30 is preferably filled until the pillow has a firmness defined by an IFD of at least about 20 Newtons with 25% deflection, and more preferably an IFD of at least about 30 Newtons with 25% deflection. Testing standards to measure such an IFD may be made in accordance with ASTM D3574-01e1, Test B, Indentation Force Deflection (modified). In the test, the indentor foot may be changed from an 8 inch diameter plate to a 4 inch diameter plate because of the shape of the pillow, the initial force may be 4.5 Newtons, and the speed may be 10 inches per minute. In some cases, the IFD may be in the range from about 20 Newtons to about 40 Newtons at 25% deflection, and in some cases from about 25 Newtons to about 35 Newtons at 25% deflection. In accordance with another measurement, the IFD may be at least about 120 Newtons at 65% deflection, and in some cases at least about 130 Newtons at 65% deflection. In some embodiments, the IFD may be in the range from about 120 Newtons to about 240 Newtons at 65% deflection, and in some cases from about 130 Newtons to about 210 Newtons at 65% deflection. When pillow 50 has a well size of about 6 inches, and a polyester fill material is used, the weight may be in the range from about 2 pounds to about 5 pounds.

Figure 6:
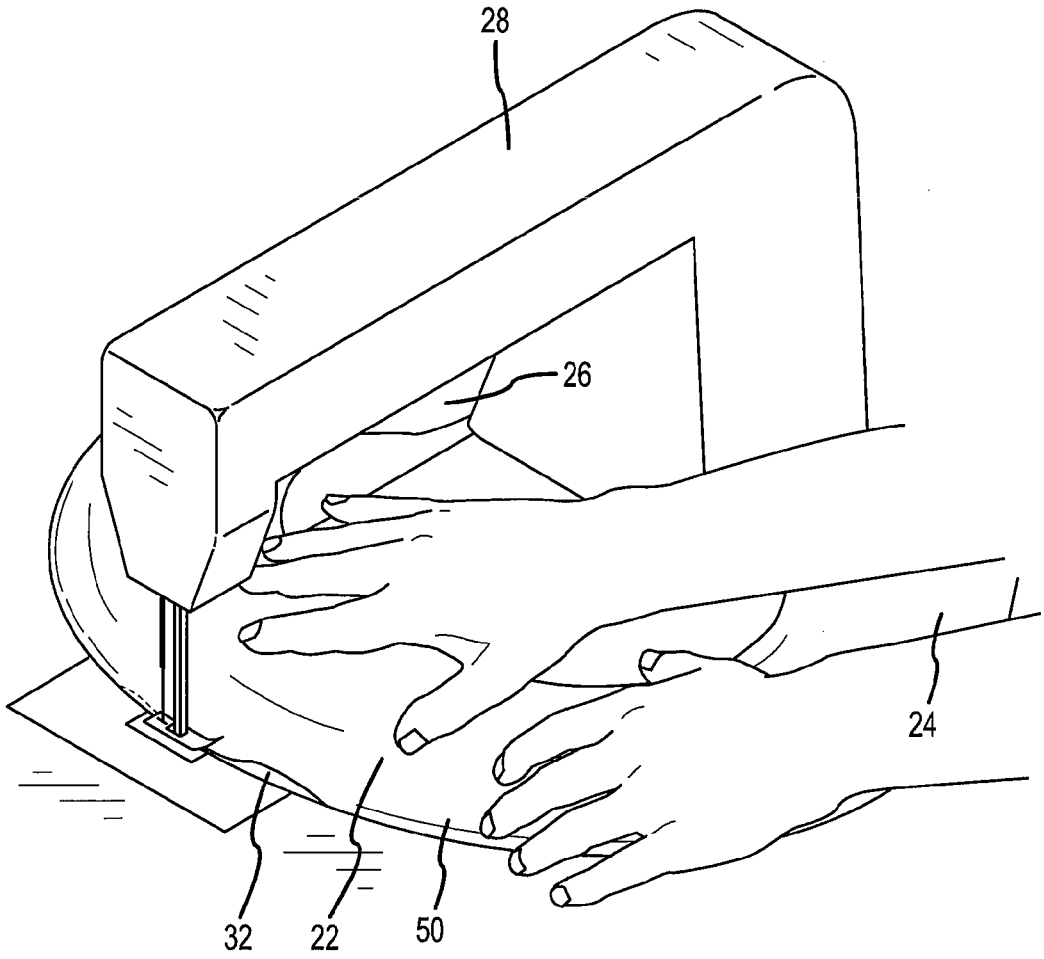
FIG. 6 illustrates a sewing machine closing an opening in a pillow shell after the pillow has been stuffed with a fill material according to one embodiment of the invention.

Following filling, opening 32 is closed by sewing the edges of skins 20 together as illustrated in FIG. 6. Pillow 50 may then be cleaned using a high pressure hose.

Figure 7:
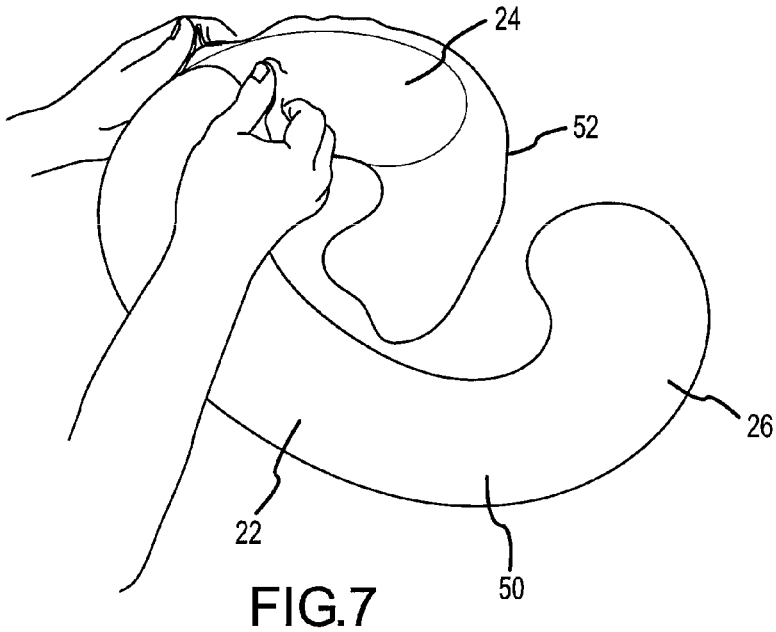
FIGS. 7 and 8 illustrate one method for placing a pillow into a packaging material according to one embodiment of the invention.
Figure 8:
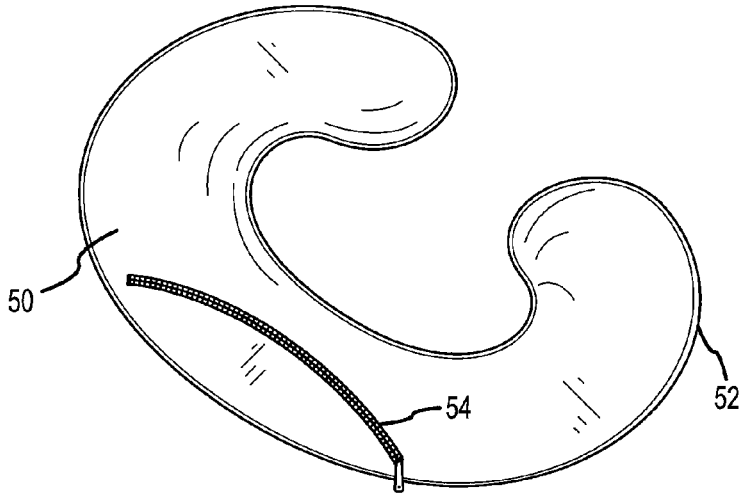

Pillow 50 may be packaged in a variety of ways. For example, as illustrated in FIGS. 7 and 8, a plastic covering 52 may be slid over pillow 50 and zipped close with a zipper 54 along midsection 22. Other packaging arrangements are described in, for example, U.S. Pat. No. 6,640,977, incorporated herein by reference.

Figure 9:
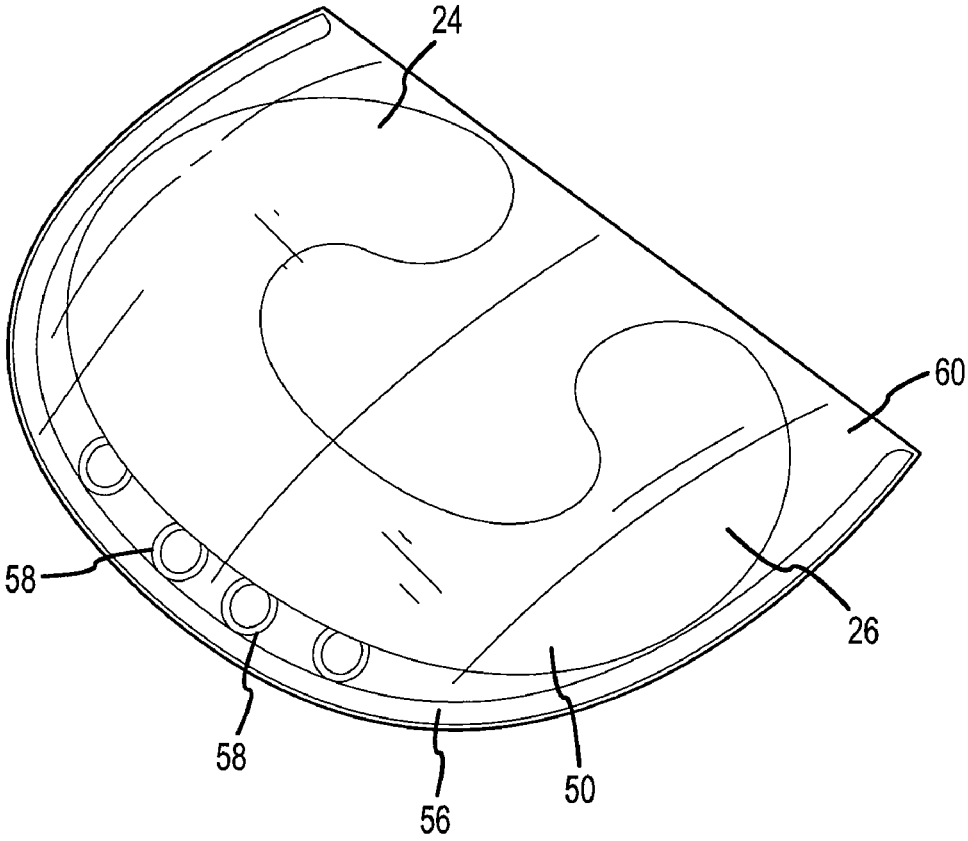
FIG. 9 illustrates another method for packaging a pillow with toy bars according to one embodiment of the invention.

As illustrated in FIG. 9, pillow 50 may be included as part of a play kit having play bars 56 that are coupled to various toys using rings 58. Examples of such kits are described in copending U.S. patent application Ser. No. 09/679139, filed Oct. 03, 2000 and Ser. No. 09/802097, filed Mar. 08, 2001, incorporated herein by reference. To package the play kit, play bars 56 may be bent and inserted into packaging 60. Pillow 50 may then be inserted into the packaging which is closed using a zipper.

Figure 10:
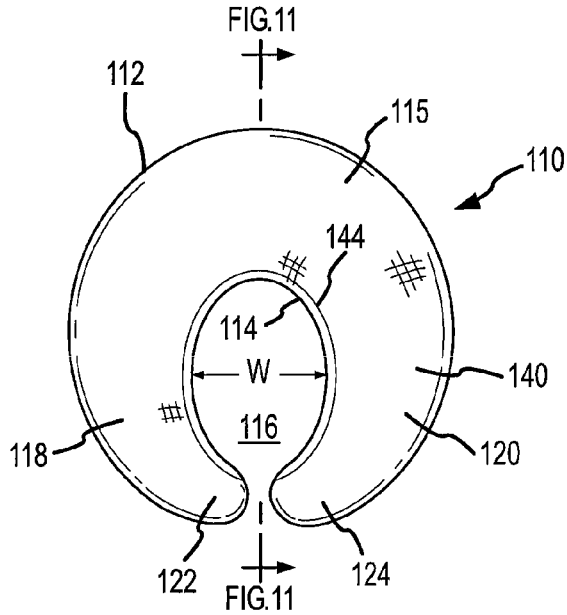
FIG. 10 is a top view of an embodiment of a support pillow according to the invention.
Figure 11:
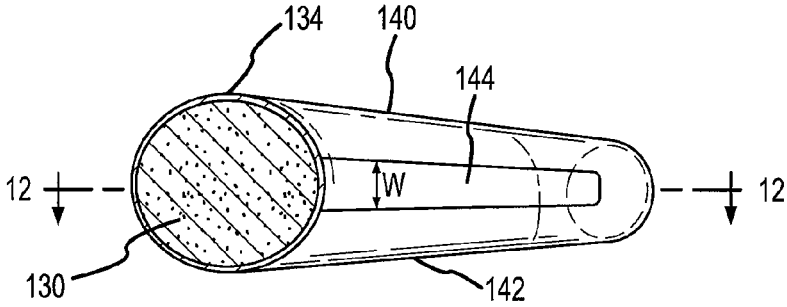
FIG. 11 is a cross sectional view of the support pillow of FIG. 10 taken along lines 2—2.
Figure 12:
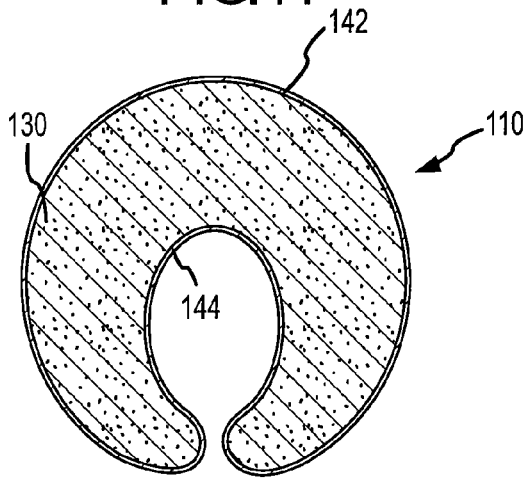
FIG. 12 is a cross sectional view of the support pillow of FIG. 11 taken along lines 3—3.

FIGS. 10–12 illustrate one embodiment of a support pillow 100 constructed according to the techniques of the invention. The support pillow 100 may be constructed to have an overall shape and feel that are similar to the support pillows described in U.S. Pat. Nos. 5,661,861, 5,546,620, 5,261,134 and 6,055,687, previously incorporated herein by reference. Support pillow 110 includes a curved outer surface 112 which is rounded in both a longitudinal and a lateral direction to form an outer perimeter. Support pillow 110 further includes a curved central inner surface 114 which defines a rounded, generally circular or elliptical well region 116. While the body of the support pillow 110 is substantially continuous and uniform, with curved surfaces 112 and 114 also being continuous, it is convenient to consider the pillow body as having a medial region 115 and two opposed arms 118 and 120. The arms 118, 120 extend in opposite directions away from the medial region 115, but are curved towards one another to give the pillow 110 its toroidal or curved configuration. While the continuous structure does not provide a precise or exact division between the medial region 115 and each arm, considering the body of the pillow in view of these components facilitates a description of the structure and function of the pillow 110.

Arms 118, 120 include respective blunt ends 120 and 124, positioned remotely of the remedial region. Support pillow 110 is proportioned so that ends 122, 124 normally, i.e., when not under external stress, touch or are slightly separated from each other. However, ends 122, 124 do not exert substantial pressure against each other, if touching. The toroidal or curved shape defined by the outer and inner curved surfaces 112, 114 is proportioned such that at a central vertical plane, represented by line 2—2 in FIG. 10, bisects pillow 110 at the medial region 115. Pillow 110 thus has bilateral symmetry with respect to the central plane. The central plane further contains a vertical, central axis about which the pillow body is formed. Profiles of the pillow 110 taken radially of the central axis, i.e., sections of the pillow 110 in planes that also contain the central axis, are elliptical in shape throughout the medial region, and likewise are elliptical throughout the length of each arm 118, 120 with the exception of blunt ends 122, 124. Perpendicular to the central vertical plane is a horizontal mid-plane that bisects pillow 110 as illustrated in FIG. 12. Hence, pillow 10 is also symmetrical about the mid-plane.

Well region 116 has a width W in the direction perpendicular to the central plane. The width W is selected to permit the support pillow to fit "snug" around the torso or waist of most users. The pillow 110 is constructed so that the arms 118, 120 may be moved away from each other to vary the width W so that the pillow 110 may be used in a variety of applications.

Referring to FIG. 11, pillow 110 includes a central core 130 which may be constructed of a resilient, compression resistant, hypoallergenic material, such as a polyester filling. The central core 130 is encased by a cover 134, such as cotton or other pliant conforming fabric. The polyester is firmly and tightly packed into cover 134 using a blowing process, such that the core 130 and cover 134 together provide a self-supporting pillow body, i.e., the support pillow 110 retains its shape without any sagging or drooping of arms 118, 120 when held at the medial region 115. The tightly packed polyester core 30 also provides the pillow with firmness in the sense that it will undergo only slight elastic deformation (as compared to a conventional pillow) when an object (such as a person's arms or elbows) is rested on the arms 118, 120 or medial region 115. Line 3—3 in FIG. 11 represents a horizontal mid-plane, with the top and bottom halves of pillow 110 being symmetrical about the mid-plane.

Cover 134 is formed of three pieces of fabric: a top piece 140, a bottom piece 142, and a center piece 144. Top piece 140 and bottom piece 142 are sewn together at the outer perimeter to form a seam. Although shown with top piece 140 and bottom piece 142, it will be appreciated that a single piece of fabric may be used to cover the top and bottom of the pillow. Sewn to top piece 140 and bottom piece 142 is center piece or gusset 144. In this way, center piece 144 surrounds the inner well, and eliminates a seam running along the mid-plane. Such a configuration permits arms 118 and 120 to be separated without tearing the fabric that is adjacent the inner well. Further, by appropriately configuring the width of center piece 144, cover 134 is sufficiently resilient to spring arms 118 and 120 back to their original shape.

Merely by way of example, when support pillow 110 is configured to be placed about an object having an outer perimeter of about 15 inches to about 45 inches, including, but not limited, the torso of a person, the width of center piece 144 (i.e., width w in FIG. 11) may be configured to permit the ends of the arms 118, 120 to come within about 8 inches, more preferably within about 5 inches, and still more preferably within about 2 inches after removal from the object. This flexibility may be achieved while the pillow 110 has a firmness of at least about 20 Newtons at 25% deflection. In such cases, center piece 144 may have a width in the range from about 1 inch to about 6 inches when a generally non-stretchable fabric, such as a cotton fabric, is used to cover the core. For such applications, the well 116 may have a diameter of about 4 inches to about 12 inches, more preferably from about 4 inches to about 8 inches, and still more preferably from about 5.5 inches to about 6.5 inches when the ends of the arms are touching. The vertical height of the medial region 115 (when the pillow is lying flat) may be in the range from about 4 inches to about 10 inches, and more preferably from about 4 inches to about 5.5 inches. The height of the arms at their ends 22, 24 may be in the range from about 1 inch to about 6 inches, and more preferably from about 2 inches to about 4 inches. The horizontal thickness of the arms and medial region (when the pillow is lying flat) may be in the range from about 4 inches to about 10 inches, and more preferably from about 4 inches to about 8 inches. The outer perimeter of the pillow may be in the range from about 15 inches to about 45 inches, and more preferably about 30 inches. When the outer perimeter is about 30 inches, the ends of the arms may be separated up to about 17 inches to about 30 inches when center piece 44 has a width from about 1 inch to about 6 inches. The separation distance may increase as the outer perimeter is increased and vice versa. For example, when the outer perimeter is about 45 inches, the ends of the arms may be separated up to about 45 inches as the width of center piece 144 approaches about 6 inches.

The invention has now been described in detail for purposes of clarity and understanding. However, it will be appreciated that certain changes and modifications may be practiced within the scope of the appended claims. For example, the techniques of the invention are not limited to the specific pillows described herein but may be used with pillows of other shapes as well.

What is claimed is:

1. A method for making a pillow, the method comprising:

cutting at least one piece of fabric to form a pair of skins that each comprise a midsection and two arm sections;

sewing the two skins together near their outer edges except for a portion of the mid section to form a shell defining a continuous interior and having a middle region with an opening into the interior at the unsewn outer edges of the skins and two opposing arms extending from the middle region to form a well region;

blowing a fill material into the interior of the shell through the opening in the middle region until the pillow has a firmness defined by an IFD of at least about 20 Newtons with 25% deflection; and closing the opening in the middle region.

2. A method as in claim 1, wherein the step of blowing the fill material further comprises inserting a nozzle through the opening of the middle region and into one of the arms, blowing fill material into the arm, moving the nozzle to the other arm and blowing fill material into the other arm, and moving the nozzle to the middle region and blowing fill material into the middle region.

3. A method as in claim 1, wherein the two skins are substantially identical, with the two arm sections curving so that their ends generally face each other.

4. A method as in claim 1, further comprising sewing a strip of fabric between the two skins so as to be adjacent to the well region.

5. A method as in claim 1, further comprising placing the pillow into, a package.

6. A method as in claim 1, wherein the fill material comprises polyester, and wherein the shell is filled to about 2.0 pounds to about 2.5 pounds with the fill material.

7. A method as in claim 1, wherein the opening is closed by sewing the skins together.

8. A method as in claim 1, wherein the skins have an outer surface and an inner surface, and wherein the skins are sewn together with the outer surfaces facing each other.

9. A method as in claim 8, further comprising turning the shell inside out such that the inner surfaces face each other.

10. A method for making a pillow, the method comprising:

cutting at least one piece of fabric to form a pair of skins that each comprise a midsection and two arm sections;

sewing the two skins together near their outer edges except for a portion of the mid section to form a shell defining a continuous interior and having a middle region with an opening into the interior at the unsewn outer edges of the skins and two opposing arms extending from the middle region to form a well region;

inserting a nozzle through the opening of the middle region and into one of the arms and blowing fill material into the arm;

moving the nozzle to the other arm and blowing fill material into the other arm;

moving the nozzle to the middle region and blowing fill material into the middle region; and closing the opening in the middle region.

11. A method as in claim 10, wherein the fill material is blown into the interior of the shell until the pillow has a firmness defined by an IFD of at least about 20 Newtons with 25% deflection.

12. A method as in claim 10, wherein the two skins are substantially identical, with the two arm sections curving so that their ends generally face each other.

13. A method as in claim 10, further comprising sewing a strip of fabric between the two skins so as to be adjacent to the well region.

14. A method as in claim 10, further comprising placing the pillow into a package.

15. A method as in claim 10, wherein the fill material comprises polyester, and wherein the shell is filled to about 2.0 pounds to about 2.5 pounds with the fill material.

16. A method as in claim 10, wherein the opening is closed by sewing the skins together.

17. A method as in claim 10, wherein the skins have an outer surface and an inner surface, and wherein the skins are sewn together with the outer surfaces facing each other.

18. A method as in claim 17, further comprising turning the shell inside out such that the inner surfaces face each other.

* * * * *